US006742758B2

(12) United States Patent
Janesky

(10) Patent No.: US 6,742,758 B2
(45) Date of Patent: Jun. 1, 2004

(54) LIGHT-WEIGHT REINFORCED, TUBULAR PLASTIC FOOTING FORM MEMBERS AND ASSEMBLIES

(76) Inventor: Lawrence M. Janesky, 11 Fawn Meadow La., Huntington, CT (US) 06484

( * ) Notice: Subject to any disclaimer, the term of this patent is extended or adjusted under 35 U.S.C. 154(b) by 38 days.

(21) Appl. No.: 09/872,005

(22) Filed: Jun. 1, 2001

(65) Prior Publication Data

US 2002/0179811 A1 Dec. 5, 2002

(51) Int. Cl.[7] ..... E01C 7/00

(52) U.S. Cl. ..... 249/7; 52/169.5; 52/274; 52/293.2; 249/6; 249/38; 249/40; 249/47; 249/165; 249/192; 404/93; 405/45; 405/251

(58) Field of Search ..... 52/34, 274, 268.1, 52/287.1, 169.5, 293.1–293.3, 65, 245; 249/2, 3, 6, 7, 13, 189, 207, DIG. 3; 404/96, 98; 405/36, 38, 43, 45, 118, 119, 50, 250, 251; 240/47, 165, 192

(56) References Cited

U.S. PATENT DOCUMENTS 2,663,925 A * 12/1953 Yates
3,613,323 A 10/1971 Hreha
4,185,429 A * 1/1980 Mendola ..... 52/274
5,224,799 A 7/1993 Parker
5,332,191 A * 7/1994 Nolan ..... 249/155
5,399,050 A 3/1995 Jacobus
5,406,758 A 4/1995 Baum
5,466,092 A * 11/1995 Semenza et al. ..... 405/45
5,474,400 A 12/1995 Kliefoth et al.
5,475,950 A 12/1995 Palmer
6,021,994 A * 2/2000 Shartzer, Jr. ..... 249/6
6,048,132 A * 4/2000 Kupke et al. ..... 405/43
6,129,838 A * 10/2000 Millner ..... 210/164
6,385,932 B1 * 5/2002 Melchiori ..... 52/302.3
6,629,681 B1 * 10/2003 Miller et al. ..... 249/3

* cited by examiner

*Primary Examiner*—Yvonne M. Horton
(74) *Attorney, Agent, or Firm*—Perman & Green, LLP

(57) ABSTRACT

Lightweight, reinforced, non-biodegradable, tubular plastic footing form members and assemblies which may contain stake-engaging bores and/or are nailable to each other and/or to supporting stakes. The form members are water-repellant to resist absorbing and bonding to wet concrete compositions so that they can be removed and cleaned for repeated reuse. Alternatively they can be left in place, since they are inexpensive and non-biodegradable, and can support a porous drain conduit adjacent the formed footing.

12 Claims, 3 Drawing Sheets

LIGHT-WEIGHT REINFORCED, TUBULAR PLASTIC FOOTING FORM MEMBERS AND ASSEMBLIES

BACKGROUND OF THE INVENTION

1. Field of the Invention

The present invention relates to novel, inexpensive, lightweight, non-biodegradable forms for simple assembly in spaced relation to produce concrete-receiving walled channels for the pouring of concrete footings to support walls of buildings such as homes and other structures.

2. State of the Art

Wood planking has been used over the years, and is still used nearly exclusively, to produce retaining forms for the installation of concrete wall footings. Wood planks have the advantage that they can be nailed to one another to provide lengths corresponding to the desired inside and outside length of the footing being formed, and can be nailed to each other at an angle, such as 90°, to produce inner and outer corners of the form to produce the necessary corners of the footing form assembly around the periphery of the structure being built.

However, the use of wood planking for footing forms has certain disadvantages. Wooden footing forms are biodegradable and therefore building codes require that they be removed after the concrete footings are poured and cured. Wood planks are also relatively heavy, and porous and water-absorbing so that they absorb and bond to the concrete composition and become heavier and difficult to remove from the cured footing, and difficult to clean for reuse.

It has been proposed to use non-biodegradable materials to produce footing form assemblies, which can be left in place adjacent the formed wall-supporting footing to provide water-drain conduits and/or radon-escape conduits around the periphery of the footing. Such structures generally are hollow, flow-permitting enclosures which admit and conduct water and/or radon gas to a desired outlet, and which are not nailed in place. Reference is made to U.S. Pat. Nos. 5,224,799; 5,399,050; 5,474,400; 5,475,950 and 5,466,092 for their disclosures of such footing forms.

Reference is also made to U.S. Pat. Nos. 3,613,323 and 5,406,758 for their disclosures of drain tile forms for forming footings with integral water drainage conduits.

SUMMARY OF THE INVENTION

The present invention provides novel footing form members which are rigid, lightweight, non-biodegradable and water-repellant for ease of installation assembly to outline the length and corners of a desired foundation footing, and permit simple removal and cleaning, if desired, for reuse.

The present footing form members are elongate plastic planks, preferably about 8 to 12 feet in length, about 7 to 10 inches wide to correspond to the height of the desired footing, and about 1.5 to 2 inches in thickness or more, to provide the necessary rigidity while permitting the planks to be abutted lengthwise and staked or nailed to provide the desired length of the form and to be abutted perpendicularly and staked or nailed to form corners of the peripheral footing form assembly.

The present plastic planks are extruded from water-resistant thermoplastic molding composition such as high impact strength polyethylene, polystyrene, acrylonitrile-butadiene-styrene (ABS) or similar compositions, in a hollow configuration having spaced inner and outer walls connected by reinforcing ribs. The spaced walls are relatively thin and may be formed of closed-cell thermoplastic polymer foam, i.e., between about 0.03 and 0.30 inch thick. The planks are nailable to each other or to supporting stakes, or frictionally-engage supporting stakes.

According to a first embodiment, the present hollow plastic planks have a bracket-shaped or C-shaped cross section with upper and lower horizontal flanges provided with aligned stake-receiving holes for receiving stakes for supporting the width of the planks in vertical position.

According to another embodiment the present planks are tubular in cross-section and hollow or filled with closed-cell thermoplastic polymer foam, and are provided with linear-spaced integral reinforcements through the width thereof to reinforce the plastic planks for nailing in vertical position along the ground to form assemblies which outline the width and height of the desired peripheral concrete footing to be poured.

DETAILED DESCRIPTION OF THE PREFERRED EMBODIMENT

Figure 1:
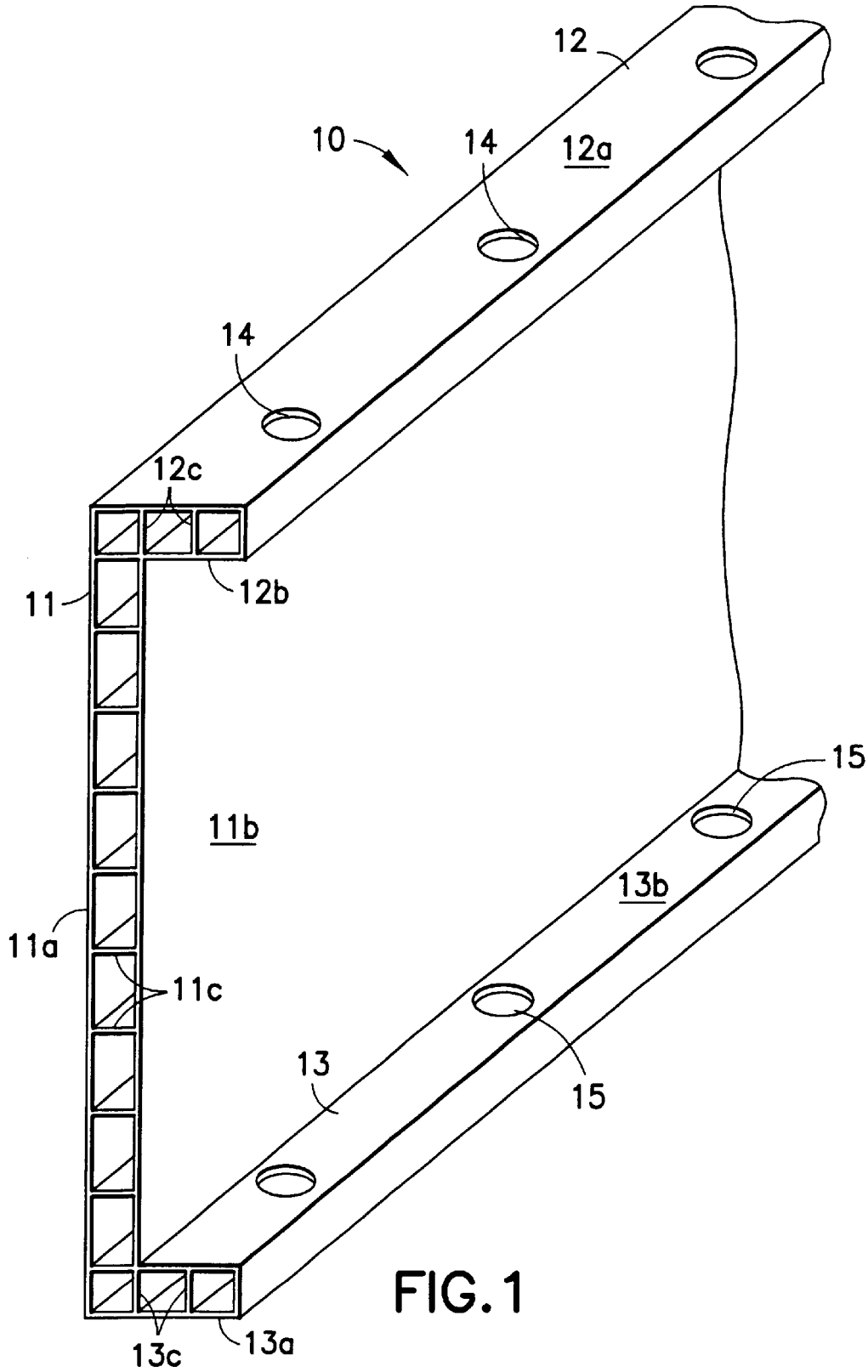
FIG. 1 is a perspective view of a stake-receiving plastic plank according to one embodiment of the present invention.

According to a first embodiment, FIG. 1 illustrates an extrusion-molded plastic plank 10 having a C bracket-shaped cross-section comprising a footing-forming vertical wall section 11 and an opposed pair of parallel upper and lower horizontal flange wall sections 12 and 13, each provided with a plurality of evenly-spaced and aligned stake-receiving holes 14 and 15, spaced pairs of which are used for receiving supporting metal stakes which are driven into the ground at desired locations and are engaged by the plank to support the plank in vertical position, widthwise, as a component of a peripheral form assembly which outlines the area into which concrete composition is poured and cured to form a peripheral wall-supporting concrete footing.

The plank wall sections 11, 12 and 13 are molded or extruded with inner and outer solid plastic surface walls 11*a* and 11*b*, 12*a* and 12*b* and 13*a* and 13*b*, about 0.04 inch thick, spaced by a desired distance such as ½ inch and reinforced and connected to each other by a plurality of spaced integral plastic ribs 11*c*, 12*c* and 13*c* of similar thickness, which extend along the length of the wall sections to impart structural strength and rigidity to the plastic forms. The forms generally have a length of about 12 feet, a vertical height of 6 to 10 inches and a flange wall thickness or width of about 1½ inches including the ½ inch thickness of the wall section 11. The reinforcing ribs 11*c*, 12*c* and 13*c* may have a diagonal configuration as illustrated by ribs 31*c*, 32*c*, and 33*c* in FIG. 3.

The plastic planks 10 need not be nailed to each other or to wooden supporting stakes since they are provided with aligned holes 14 and 15 in the flange wall sections 12 and 13 which are spaced by six or twelve inches or more, and which receive cylindrical metal stakes which are driven into the ground at desired or convenient spaced intervals, such as 3 to 4 feet, using the aligned pairs of holes at the selected intervals. The planks 10 are then leveled at the required height and are then secured at that height to the stakes by any suitable means.

After the concrete is poured and cured, the stakes and planks may be removed for reuse if desired, or the planks may be left in place since they are not biodegradable. Removal and reuse is simplified because the smooth plastic walls of the planks are water-repellant and separate from the concrete footing easily. Moreover they are easy to scrape and/or clean with a water hose since they do not absorb or retain the concrete composition.

If the plastic plank assembly is left in place, to be covered with backfill, some of the upper holes 14 can be used to support a porous water conduit by means of hangers or plastic ties or metal wire, to assist in the drainage of water from the periphery of the footing to a dry well or aggregate drain bed.

Figure 2:
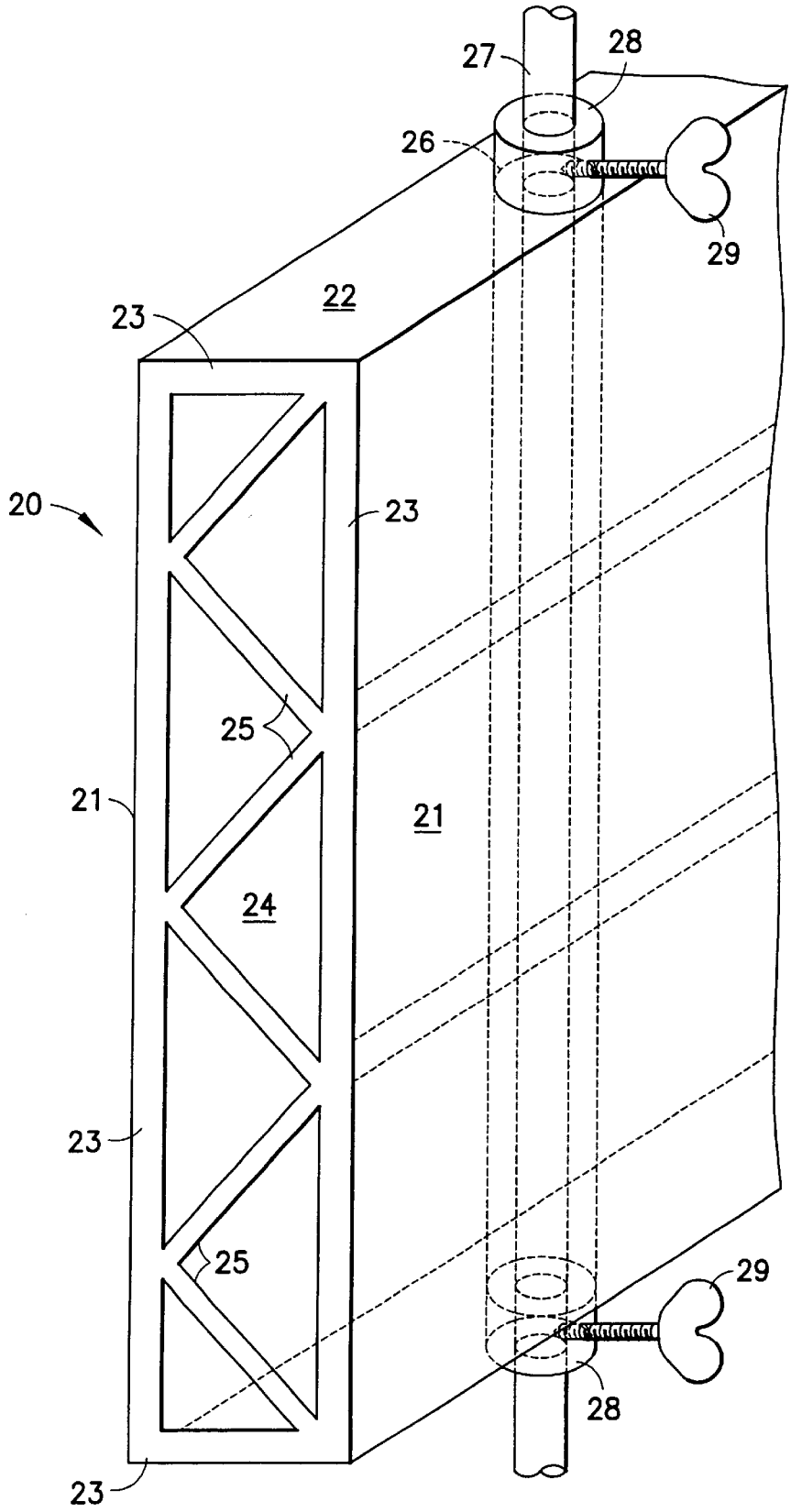
FIG. 2 is a perspective view of a segment of a zig-zag-reinforced plastic plank illustrating the presence of a round metal supporting stake and a stake-receiving and engaging member according to another embodiment of the present invention.

FIG. 2 illustrates an extrusion-molded, nailable plastic plank 20 according to another embodiment of the present invention. Plank 20 is an elongate hollow molded plastic body having outer face surfaces 21, and outer edge surfaces 22. The molded outer walls 23 of the plank 20 have a thickness of between about ⅛" and ⅜", preferably about ¼ inch, and the hollow space 24 between the walls 23 includes an integral molded wall-reinforcement rib structure 25 which, in the illustrated embodiment is a zig-zag diagonal rib structure, comprising elongate ribs which engage and are integral with the outer walls 23 of the plank, along the length thereof, to stiffen and strengthen the plank 20. The rib structure 25 has a wall thickness between about 1/16" and 3/16", preferably about ⅛ inch.

FIG. 2 illustrates an optional embodiment in which the plank 20 is provided with a plurality of space widthwise bores 26, corresponding to the spaced hole pairs 14/15 shown in FIG. 1, which are designed to receive metal stakes 27 therethrough. A stake 27 is inserted through some of the holes 26, corresponding to desired or convenient ground support areas along the periphery of the intended footing, and each stake is driven into the ground solidly. Then the plank 20 is leveled as desired, and clamp devices comprising a ring 28 and wing nut 29 are tightened around the metal stake to hold the plank 20 at that level. Optionally the stakes can be driven into the ground, outside of the planks, and nails can be driven through the stakes and into the planks at desired intervals to support the planks in the desired positions.

The elongate planks 20 may be varied in dimensions but generally have a length between about 8 and 16 feet, a thickness between outer wall surfaces 21 of from about 1¼" and 2", preferably about 1½ inch, and a width or height, between outer wall surfaces 22 of from about 6 and 10 inches, preferably about 7½ inches.

The reinforced plastic planks 20 preferably are molded from conventional closed-cell foam-forming thermoplastic resin molding compositions such as conventional polyurethane polyester, polyether or polyamide compositions, polyethylene compositions, etc., which form rigid, hard lightweight bodies having a smooth outer surface skin which is impervious to wet concrete compositions used to pour the footings. The rib structure 25 is integrally-formed during the suitable extrusion-molding process, and other suitable rib structures can also be formed such as with ribs which extend perpendicularly between the walls 21, as shown in FIG. 1.

Alternatively, the planks 20 may be formed with a solid core of the plastic foam composition, instead of the rib structure 25, to form the peripheral plastic footing assembly.

An important feature of the planks 20, whether molded of high impact strength thermoplastic resin composition, similarly to planks 10 of FIG. 1, or molded from foam-forming composition, as discussed supra is that they are nailable to each other and to wooden supporting stakes to form peripheral footing-forming assemblies to enclose the trough or channel into which the wet concrete is poured and cured to form the wall-supporting footing.

Figure 3:
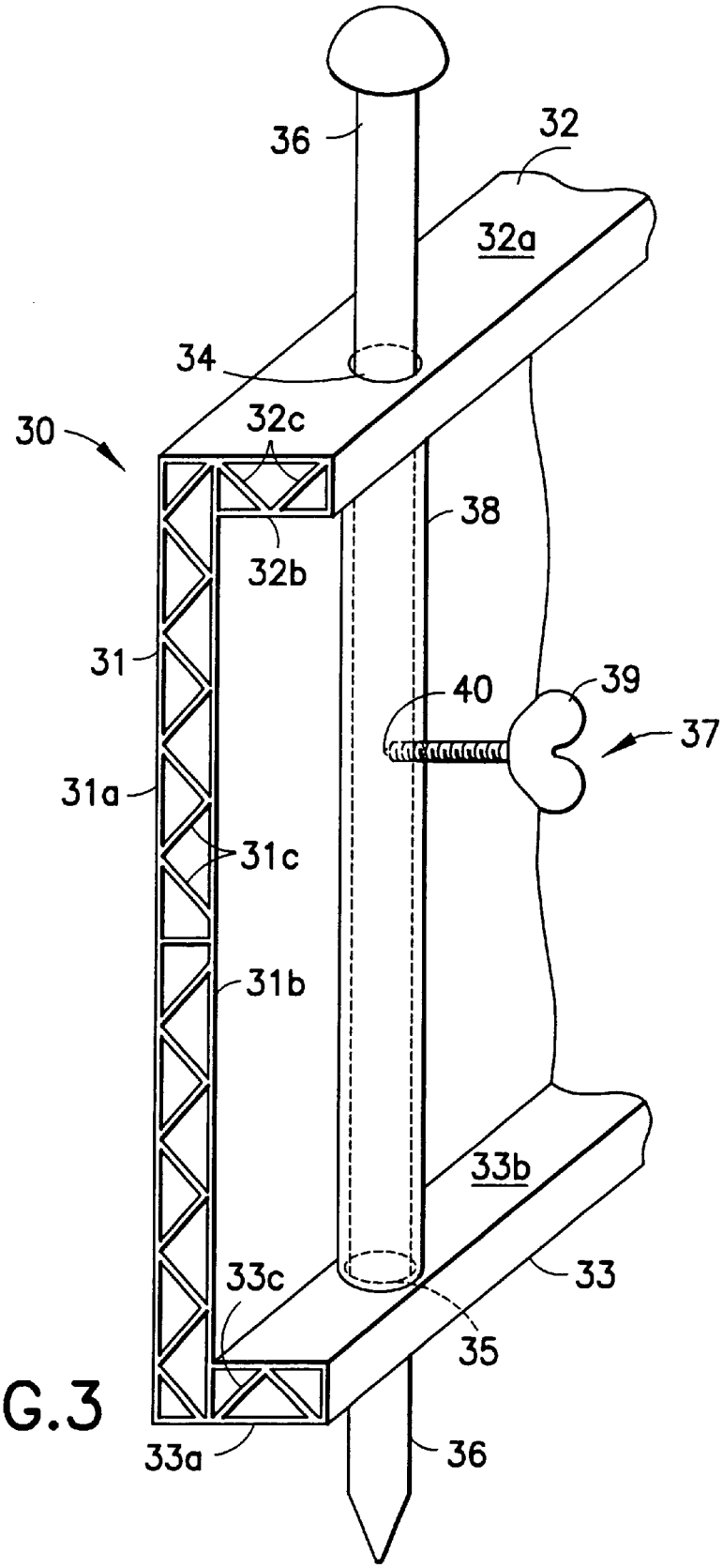
FIG. 3 is a perspective view of a bracket-shaped plastic plank, similar to that of FIG. 1, but which has diagonal wall reinforcements, for improved nail-retention properties, and is shown in association with a supporting stake and a stake-engaging member.

The footing form members 10 shown in FIG. 1 are not nail-retentive but are intended to be supported by stakes driven into the ground at desired, convenient spaced intervals corresponding to the location of selected pairs of holes 14 and 15. However if the integral reinforcements 11*c*, 12*c* and 13*c* extend diagonally between the walls 11*a* and 11*b*, 12*a* and 12*b* and 13*a* and 13*b*, as illustrated in FIG. 3, the footing members are nailable to each other and to wooden stakes since nails will pass through the walls and through the reinforcing ribs to provide adequate nail-retention properties. This is also true if the members 10 of FIG. 1 are extruded to have thick plastic foam walls or a solid plastic foam core or diagonal ribs, which provide good nail retention properties.

Referring to the embodiment of FIG. 3, the extrusion-molded, nailable plastic plank 30 thereof is similar to the bracket-shaped plank 10 of FIG. 1 except that the reinforcing ribs 31*c*, 32*c*, and 33*c* thereof extend at an angle or diagonally between the walls 31*a* and 31*b*, 32*a* and 32*b* and 33*a* and 33*b* of the plank 30.

The diagonal ribs 11*c*, 12*c* and 13*c* lend strength and rigidity to the planks 30, and the ribs 11*c* improve the nailability or nail-retention properties of the wall section 31 since nails driven therethrough into a supporting wooden stake or into a similar plastic plank will also pass through the reinforcing rib 31*c* for increased anchoring.

FIG. 3 also illustrates an optional means for connecting the plastic plank 30 to a stake 36 passed through an aligned pair of stake-receiving holes 34 and 35 in the flange wall sections 32 and 33, similar to holes 14 and 15 in wall sections 12 and 13 of FIG. 1.

The plank 30 is secured to the metal stake 36 at the desired position, after the stake 36 is driven into the ground and the plank 30 is leveled, by means of a stop member 37 which engages the undersurface 32*b* of the plank wall flange section 32 and the stake 36 to prevent the plank from sliding down the stake. In FIG. 3, the stop member 37 comprises a sleeve 38 which surrounds the stake 36, at least adjacent the undersurface 32*b*, and a wingbolt 39 which threadably engages the sleeve 38 and has a pointed tip 40 which grips the metal stake 36 to lock the sleeve 38 thereto. In the illustrated embodiment the sleeve 38 extends fully between the parallel flange surfaces 32*b* and 33*b* and may be fixed in position, one for each pair of aligned holes 34 and 35 along the length of the plank 30, so that any selected, convenient pair of holes can be used to receive and engage the spaced ground support stakes 36.

Also, since the plank 30 of FIG. 3 is nailable, the sleeve 38 can be omitted and a nail can be driven through a wooden stake 36 and into the vertical wall 31, or through the horizontal flange wall 32 and into the stake 36 within the upper hole 34. Also, a metal stake 36 can be used if it is pre-drilled with a plurality of vertically-spaced holes, one of which will receive a nail bolt or pin passed or screwed through the flange wall 32 or to be screwed or driven into the vertical wall 31.

The plastic forms 10 and 30 according to the first embodiment of the present invention, illustrated by FIGS. 1 and 3, are inexpensive to manufacture and very lightweight, which is an advantage to installers who have to work on uneven, excavated, often muddy terrain. The low cost enables them to be left in place, preferably as supports for a perforated drainage conduit, which avoids the cost of labor required to remove them from the cured footing and to clean them for reuse.

The plastic forms 20 according to the second embodiment of the invention, illustrated by FIG. 2, are more expensive and more durable because they have a greater wall thickness, such as of dense plastic foam, and have a thicker reinforcement web 25 and/or plastic foam core, which provides the important advantage of nail-retention. However they are still much lighter than wood planks, do not absorb or bond to wet concrete, and can be removed and reused twenty or more times.

If desired for additional strength against spreading of the opposed walls of the footing form assembly under the weight of the poured wet concrete composition, the opposed walls of the footing form members may be attached to each other by spaced lower metal or plastic strapping strips or wires and spaced upper metal or plastic strapping strips or wires, which extend across the width of the concrete-receiving trough and restrain the opposed form members against separation. Alternatively, the wooden or metal stakes can be relied upon to restrain the footing form members against separation, assisted by spaced upper 1×3 inch wood strapping members which are nailed to the upper edges the opposed footing form members to maintain them at the desired spacing before and after the concrete is poured.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. Lightweight, reinforced water-repellant plastic footing form members for use in opposed assemblies for retaining and forming the walls of a desired concrete footing to be poured therebetween, along the length and height of said footing, each of said form members comprising elongate double-wall tubular members having a pair of spaced vertical outer walls, each having an outer surface and an inside surface, each wall having a height of between 6 and 10 inches, and said inside surfaces being connected to each other by means of horizontal top and bottom walls and by a plurality of integral horizontal or diagonal longitudinal plastic reinforcing ribs which extend between and are integrated with spaced areas of the inside surfaces of said outer walls, spaced throughout the entire height thereof, to reinforce said outer walls against compression towards each other and to impart rigidity and strength to said elongate members, said elongate double-wall members further comprising a pair of elongate horizontal flange members extending in parallel relation to each other from the top and bottom walls of said elongate double-wall members, along the length of said form members to give said form members a C-shaped cross-section, said parallel flange members each having a plurality of spaced transverse holes, aligned with the holes in each other, to receive and engage two or more spaced ground stakes designed to support the footing form members with their elongate double-wall members perpendicular to the ground, as an element of a footing form assembly.

2. Footing form members according to claim 1 in which said longitudinal plastic reinforcing ribs are uniformly spaced from each other and extend horizontally between said inside surfaces of said outer walls.

3. Footing form members according to claim 1 in which said elongate wall members are extruded from high impact strength plastic molding composition.

4. Footing form members according to claim 1 in which said elongate wall members are extruded from closed-cell plastic foam-forming molding composition.

5. Footing form members according to claim 1 which are nailable to each other and to ground-support stakes to form a footing form assembly.

6. Footing form members according to claim 1 further comprising a stop member associated with each said plurality of aligned holes, which receives a ground stake, comprising means for engaging said ground stake and said member to secure the member in fixed position relative to the ground.

7. Footing form members according to claim 6 in which said stop member is a nail through said stake and said member.

8. Footing form members according to claim 6 in which said stop member comprises a sleeve member aligned between said holes to receive a ground stake and adapted to be fastened thereto against the form member.

9. Footing form members according to claim 8 in which said sleeve member extends between the elongate flange members, and comprises a screw means threadably engaged within the sleeve member and against the ground stake.

10. Footing form members according to claim 4 comprising a plurality of spaced holes extending transversely between the spaced walls of said elongate wall member, each said hole being designed to receive a ground-supporting stake for attachment to the form member to support the form member in desired position as an element of a footing form assembly.

11. Lightweight, reinforced water-repellant plastic footing form members for use in opposed assemblies for retaining and forming the walls of a desired concrete footing to be poured therebetween, along the length and height of said footing, each of said form members comprising elongate double-wall tubular members having a pair of spaced vertical outer walls, each having an outer surface and an inside surface, each wall having a height of between 6 and 10 inches, and said inside surfaces being connected to each other by means of horizontal top and bottom walls and by a plurality of integral longitudinal plastic reinforcing ribs which extend between and are integrated with spaced areas of the inside surfaces of said outer walls, spaced throughout the entire height thereof, to reinforce said outer walls against compression towards each other and to impart rigidity and strength to said elongate members in which said longitudinal plastic reinforcing ribs extend diagonally, in zig-zag cross-section, between said inside surfaces of said outer walls, to permit transverse nails to be driven through both the outer walls and a reinforcing rib to improve the nailability of said members.

12. Elongate, lightweight, substantially non-biodegradable, reinforced tubular footing form member designed to be cut into predetermined lengths and assembled as uniformly-spaced pairs to provide a cement-retaining enclosure for the formation of wall-supporting footings, said footing form members comprising elongate, hollow-plastic extrusions having closely-spaced opposed outer walls each having an outer surface and an inside surface, said inside surfaces being connected to each other by top and bottom walls, and by a plurality of spaced interior reinforcing ribs forming a plurality of elongate tubular passages within said extrusions spaced throughout the entire height of said opposed outer walls, said extrusions comprising a planar, elongate wall section having an outer cement-retaining wall surface, and an opposed pair of substantially parallel upper and lower integral flange sections extending perpendicular from upper and lower areas of said planar elongate wall section in a direction away from said outer cement-retaining wall surface to give said form members a C-shaped cross-section, said flange sections having a plurality of aligned transverse openings designed to receive supporting stakes therethrough and into the ground to hold opposed footing form mentors in position, with the lower flange member of each substantially-parallel with the ground and with the outer cement-retaining wall surface of each extending vertically a distance equal to the desired height of the cement footing to be formed, the cement-retaining surfaces of opposed footing form members being uniformly-spaced by a distance equal to the desired width of the cement footing to be formed.

* * * * *